US005645686A

United States Patent [19]

Troughton et al.

[11] Patent Number: 5,645,686

[45] Date of Patent: Jul. 8, 1997

[54] PROCESS FOR BLEACHING A PULP IN A SEQUENCE INCLUDING AN ENZYME STAGE

[75] Inventors: Nicholas A. Troughton; François Desprez; Johan Devenyns; Pierre Ledoux, all of Brussels; René Detroz, Ohain, all of Belgium

[73] Assignee: Solvay Interox (Société Anonyme), Brussels, Belgium

[21] Appl. No.: 322,419

[22] Filed: Oct. 13, 1994

[30] Foreign Application Priority Data

Oct. 22, 1993 [BE] Belgium ..... 09301131

[51] Int. Cl.[6] ..... D21C 9/147; D21C 9/16

[52] U.S. Cl. ..... 162/65; 162/72; 162/76; 162/78; 162/82

[58] Field of Search ..... 162/76, 65, 78, 162/88, 89, 56, 60, 72, 82

[56] References Cited

U.S. PATENT DOCUMENTS

| | | | |
|---|---|---|---|
| 5,179,021 | 1/1993 | Manoir | 162/72 |
| 5,246,543 | 9/1993 | Meier et al. | 162/76 |

FOREIGN PATENT DOCUMENTS

| | | | |
|---|---|---|---|
| 92/1626 | 3/1992 | South Africa . | |
| 92/03540 | 3/1992 | WIPO | 162/72 |
| 92/15752 | 9/1992 | WIPO . | |

OTHER PUBLICATIONS

Abstract Bulletin of the Institute of Paper Science and Technology, vol. 64, No. 2, Aug. 1993, Atlanta, US, p. 224. Ragauskas et al. "Effect of xylanase pretreatment procedures for nonchlorine bleaching".

"Bleaching of eucalyptus kraft pulp with the EnZone process", Yang et al., Tappi Journal, vol. 76, No. 7, Jul. 1993, Atlanta, US, pp. 91–96.

Kirk–Othmer: "Encyclopedia of Chemical Technology", Third Edition, vol. 19, New York, 1982, pp. 415 and 416.

Kappel: "HC–Peroxidbleiche fuer Zellstoff", Wochenblatt fuer Papierfabrikation, 120, May 1992, No. 9, pp. 328–334.

Ullmann's Encyclopedia of Industrial Chemistry, 5th Edition, vol. A18, 1991, pp. 568 and 569.

*Primary Examiner*—Steven Alvo

*Attorney, Agent, or Firm*—Spencer & Frank

[57] ABSTRACT

Process for bleaching a chemical paper pulp by means of a sequence of treatment stages involving at least one stage with an enzyme and at least one stage with a peroxyacid.

30 Claims, No Drawings

PROCESS FOR BLEACHING A PULP IN A SEQUENCE INCLUDING AN ENZYME STAGE

The invention relates to a process for bleaching a chemical paper pulp.

It is known to treat unbleached chemical paper pulps obtained by cooking cellulose materials in the delignifying and bleaching treatment stages involving the use of oxidizing chemical products. The first stage of a conventional sequence of chemical pulp bleaching has the object of perfecting the deliquification of the unbleached pulp as it exists after the cooking operation. This first deliquifying stage is traditionally carried out by treating the unbleached pulp with chlorine in acidic medium or with a chlorine/chlorine dioxide combination, as a mixture or in sequence, so as to react with the residual lignin of the pulp and to give rise to chlorolignins which could be extracted from the pulp by solubilization of these chlorolignins in alkaline medium in a subsequent treatment stage.

For various reasons, it proves useful, in certain situations, to be able to replace this first deliquifying stage by a treatment which no longer requires a chlorinated reactant.

For about twenty years, it has been proposed to precede this first treatment stage by means of chlorine or a chlorine/chlorine dioxide combination by a stage with gaseous oxygen in alkaline medium (Kirk-Othmer, Encyclopedia of Chemical Technology, Third Edition, Vol. 19, New York, 1982, page 415, 3rd paragraph and page 416, 1st and 2nd paragraphs). The degree of delignification which is obtained by this treatment with oxygen is not, however, sufficient if the aim is to produce chemical pulps of high brightness whose mechanical properties are not damaged.

It has been proposed to bleach sulphite or sulphate pulps by means of high-strength hydrogen peroxide in the presence of sodium silicate (J. Kappel, HC-Peroxidbleiche für Zellstoff, Wochenblatt für Papier-fabrikation, 120, May 1992, No. 9, pages 328–334). It is, however, difficult with this process to obtain a final brightness greater than 85° ISO, even at the price of significant amounts of hydrogen peroxide greater than 3 g/100 g of dry pulp.

The invention overcomes these disadvantages of the known processes, by providing a new delignification and/or bleaching process for chemical paper pulps which makes it possible to achieve high levels of brightness or to improve the level of brightness of bleached pulps by means of known bleaching sequences without, however, excessive damage to the cellulose.

To this end, the invention relates to a process for bleaching a chemical paper pulp by means of a sequence of treatment stages according to which the sequence comprises at least one stage with at least one peroxyacid (Stage Å) and at least one stage with an enzyme arising from a bacterium of the Bacillus genus (Stage X), carried out in any order.

Chemical paper pulp is understood to denote the pulps which have been subjected to a delignifying treatment in the presence of chemical reactants such as sodium sulphide in alkaline medium (kraft cooking or sulphate cooking), sulphur dioxide or a metal salt of sulphurous acid in acidic medium (sulphite cooking or bisulphite cooking). This term is also understood to denote the chemi-mechanical pulps and the semi-chemical pulps, for example those where the cooking was carried out using a salt of sulphurous acid in neutral medium (neutral sulphite cooking, also called NSSC cooking), which can also be bleached by the process according to the invention, as well as the pulps obtained by processes using solvents, such as, for example, the Organosolv, Alcell®, Organocell® and Asam pulps described in Ullmann's Encyclopedia of Industrial Chemistry, 5th Edition, Vol. A18, 1991, pages 568 and 569.

The invention is particularly aimed at the pulps which have been subjected to a kraft cooking or a sulphite cooking. All the types of wood used for the production of chemical pulps are suitable for the use of the process of the invention, and in particular those used for kraft pulps and sulphite pulps, namely softwoods such as, for example, the various species of pine and fir, and the hardwoods such as, for example, beech, oak, eucalyptus and hornbeam.

According to the invention, Stage Å with a peroxyacid is understood to denote a stage in which an acid is used which contains, in this molecule, at least one hydroperoxy group —O—O—H or alternatively an ammonium or any metal salt of this acid. The peroxyacids in accordance with the invention can belong, without distinction, to the organic or inorganic peroxyacid family.

According to a first variant of the invention, the peroxyacid is an organic peroxyacid. The organic peroxyacids in accordance with the invention are selected from performic acid and the aliphatic, cyclanic or aromatic peroxyacids.

When the peroxyacid is an aliphatic peroxyacid, it is selected from the peroxyacids containing from one to three percarboxyl groups.

The aliphatic peroxyacids containing a single percarboxyl group preferably comprise a linear or branched saturated alkyl chain of less than 11 carbon atoms and, most preferentially, less than 6 carbon atoms. Examples of such peroxyacids are peroxyacetic acid, peroxypropanoic acid, peroxybutanoic acids and peroxypentanoic acids. Peroxyacetic acid is particularly preferred due to its absence of toxicity and the relative simplicity of its methods of preparation.

The aliphatic peroxyacids containing two and three percarboxyl groups in accordance with the invention are selected from di- and triperoxycarboxylic acids containing a linear or branched alkyl chain of less than 16 carbon atoms. In the case of the diperoxyacids, it is preferable that the two percarboxyl groups substitute carbon atoms situated in positions which are alpha and omega with respect to one another. Examples of such diperoxyacids are 1,6-diperoxyhexanedioc acid, 1,8-diperoxyoctanedioc acid, 1,10-diperoxydecanedioc acid and 1,12-diperoxydodecanedioc acid. A triperoxyacid example is triperoxycitric acid.

The aromatic peroxyacids in accordance with the invention are selected from those which contain at least one peroxycarboxyl group per benzene ring. Preferably, the aromatic peroxyacids will be chosen which contain only a single peroxycarboxyl group per benzene ring. An example of such an acid is peroxybenzoic acid.

Another variant of the process according to the invention consists in choosing an organic peroxyacid substituted by any organic functional substituent. Organic functional substituent is understood to denote a functional group such as the alcohol group, the groups containing nitrogen such as the nitrile, nitro, amine and amide groups and the groups containing sulphur such as the sulpho and mercapto groups.

According to a second variant of the invention, the peroxyacid is an inorganic peroxyacid. The inorganic peroxyacids in accordance with the invention can contain one or a number of hydroperoxy groups. The inorganic peroxyacids containing a single hydroperoxy group are, however, preferred. Examples of such inorganic peroxyacids are the sulphuric, selenic, telluric, phosphoric, arsenic and silicic peroxyacids. Good results were obtained with peroxymonosulphuric acid, also known as Caro's acid.

Mixtures of different organic and/or inorganic peroxyacids are also well suited.

The consistency of the pulp in the treatment stage with the peroxyacid will generally be chosen of at least 3% by weight of solids and, preferably, of at least 5% of solids. Most often, the consistency will not exceed 50% of solids and, preferably, not exceed 40%.

In the process according to the invention, the amount of peroxyacid used is chosen as a function of the residual lignin level in the pulp and of the mean duration of the treatment. Generally, amounts of peroxyacid with respect to the dry pulp of at least 0.1% and, preferably, of at least 1% by weight of active oxygen expressed as $H_2O_2$ equivalent are well suited. An amount of peroxyacid will most often be used which does not exceed 10% by weight of $H_2O_2$ equivalent active oxygen with respect to the dry pulp and, preferably, which does not exceed 5% of this weight.

Another variant of the process according to the invention consists in carrying out the stage with a peroxyacid in the presence of a stabilizing agent. The known stabilizing agents of peroxygenated products are well suited. Examples of such stabilizing agents are alkaline-earth metal salts, in particular soluble magnesium salts, soluble inorganic phosphates and polyphosphates such as alkali metal pyrophosphates and metaphosphates, alkali metal silicates, organic polycarboxylates such as tartaric, citric, gluconic, diethylenetriaminepentaacetic or cyclohexanediaminetetraacetic acids and their soluble salts, poly(α-hydroxyacrylic acid)s and their soluble salts and organic polyphosphonates such as ethylenediaminetetra(methylenephosphonic), diethylenetriaminepenta(methylenephosphonic) or cyclohexanediaminetetra(methylenephosphonic) acids and their soluble salts. It is also possible to combine a number of these stabilizing agents as a mixture.

The stabilizing agent is preferably chosen from the class of phosphonic acids and their salts. It will preferably be selected from (1-hydroxyethylidene)diphosphonic acid (HEDPA), ethylenediaminetetra(methylenephosphonic) acid (EDTMPA), diethylenetriaminepenta (methylenephosphonic) acid (DTMPA), triethylenetetraminehexa(methylenephosphonic) acid (TTHMPA), pentaethylenehexamineocta (methylenephosphonic) acid (PHOMPA), cyclohexanediaminetetra(methylenephosphonic) acid (CDTMPA) and nitrilotri(methylenephosphonic) acid (NTMPA). DTMPA and its salts have given excellent results.

The total amounts of stabilizing agent to be used depend on the type of wood and the cooking process used. As a general rule, it is recommended to use an amount of stabilizing agent of at least 0.05% by weight with respect to the solids content and, preferably, of at least 0.2% by weight. Amounts of stabilizing agent not exceeding 3% by weight with respect to the solids content and, preferably, not exceeding 2% by weight are generally sufficient.

The treatment with the peroxyacid according to the invention can also be carried out in the presence of a number of stabilizing agents used as a mixture.

According to the invention, Stage X of treatment with at least one enzyme consists in treating the pulp with a composition containing at least one enzyme.

Enzyme is understood to denote any enzyme capable of facilitating the delignification, by treatment stages subsequent to the treatment stage with the enzyme, of an unbleached chemical paper pulp originating from the cooking operation or of a chemical paper pulp which has already been subjected to one or a number of bleaching stages by oxidizing reactants such as oxygen, hydrogen peroxide and ozone.

Preferably, an alkalophile enzyme will be used, that is to say an enzyme whose maximum efficiency lies in the region of alkaline pHs, and very particularly at a pH of 7.5 and more.

A category of enzymes well suited to the process according to the invention are the hemicellulases. These enzymes are capable of reacting with the hemicelluloses to which the lignin present in the pulp is fixed.

Preferably, the hemicellulases used in the process according to the invention are xylanases, that is to say hemicellulolytic enzymes capable of cutting the xylan bonds which constitute a major part of the interface between the lignin and the remainder of the carbohydrates. A xylanase example in accordance with the process according to the invention is 1,4-β-D-xylan xylanohydrolase, EC 3.2.1.8.

The preferred xylanases in the processes according to the invention can be of various origins. They may, in particular, have been secreted by a wide range of bacteria of the Bacillus genus.

The xylanases derived from bacteria of the Bacillus genus and of the pumilus species have given excellent results. Among the latter, the xylanases arising from *Bacillus pumilus* PRL B12 are very particularly advantageous.

The xylanases from *Bacillus pumilus* PRL B12 in accordance with the invention can arise directly from a strain of *Bacillus pumilus* PRL B12 or alternatively from a host strain of a different microorganism which has been genetically manipulated beforehand in order to express the genes of *Bacillus pumilus* PRL B12 encoding for the degradation of xylans.

Preferably, a purified xylanase will be used which does not contain other enzymes. In particular, it is preferred that the xylanase in accordance with the process according to the invention does not contain cellulase, in order not to destroy the polymeric chains of cellulose of the pulp.

An advantageous variant of the process according to the invention consists in carrying out Stage X in the presence of at least one sequestering agent of metal ions. The sequestering agents of metal ions can advantageously be chosen from the stabilizing agents of peroxyacids described above.

According to the invention, Stage Å and Stage X can be carried out in any order in the sequence of bleaching stages. They can be carried out consecutively or be separated by one. or a number of other known bleaching stages. Stage Å or Stage X can lie at the beginning of the sequence, at the end of the sequence or in any position within the latter.

The process in accordance with the invention can be used in conventional bleaching sequences beginning with a first stage with chlorine in acidic medium or with chlorine in acidic medium in combination with chlorine dioxide ($Cl_2$ and $ClO_2$ mixture or introduction of the two reactants sequentially). A preliminary stage with oxygen can also precede the stage with chlorine in acidic medium or with chlorine in acidic medium in combination with chlorine dioxide. In these sequences, it is possible to reduce the amounts of chlorine and/or of chlorine dioxide used while maintaining the same final brightness of the pulp produced. Examples of such sequences are: $C_D$EpÅPXDP, C/DEpÅPXDP, OC$_D$EpÅPXDP, OC/DEpÅPXDP, $C_D$XQPÅP, C/DXQPÅP, OC$_D$XQPÅP, OC/DXQPÅP, $C_D$XEDPÅ, C/DXEDPÅ, OC$_D$XEDPÅ or OC/DXEDPÅ in which the abbreviations used have the following meaning:

Å: stage with a peroxyacid in accordance with the invention

C: stage with chlorine in acidic medium

D: stage with chlorine dioxide $C_D$: stage with chlorine in acidic medium in combination with chlorine dioxide (reactants introduced sequentially into the pulp)

C/D; stage with chlorine and chlorine dioxide introduced as a mixture into the pulp E: stage of alkaline extraction with an alkali metal or alkaline-earth metal hydroxide Ep: stage of alkaline extraction reinforced with hydrogen peroxide P: stage with hydrogen peroxide in alkaline medium Q: stage with at least one sequestering agent of metal ions X: stage with an enzyme in accordance with the invention.

The process according to the invention is also particularly well suited to bleaching sequences which are free from elemental chlorine (sequences known as: ECF or "elemental chlorine free") or entirely free from chlorine (TCF or "total chlorine free"). It makes it possible, in this type of sequence, to more easily achieve the objective of reduction of the amount of chlorine used with less degradation of the pulp for the same level of final brightness or for a final brightness greater than that which it is possible to obtain by means of conventional sequences.

Examples of ECF sequences in accordance with the invention are: XÅPDP, XÅDPD, XÅPDPD, XOPÅP, XPÅPDP, OXPÅPDP, DEpÅPXDP, ODEpÅPXDP, DXQPÅP, ODXQPÅP, DXEDPÅ or ODXEDPÅ.

Examples of TCF sequences in accordance with the invention are: X/QPÅP, X/QEoÅP, X/QEopÅP, OX/QPÅP, OX/QEoÅP, OX/QEopÅP, X/QÅEpP, OX/QÅEpP, XqPÅP, XqEoÅP, XqEopÅP, OXqPÅP, OXqEoÅP, OXqEopÅP, X/QÅPÅP, X/QÅPP or OX/QÅPP. It is also possible, in these sequences, to replace Stage X/Q or Xq with two separate Stages X and Q, optionally separated by a washing and carried out in any order (QX or XQ), such as, for example, the sequences OQXPÅP and OXQPÅP.

In these examples, the abbreviations Xq and X/Q respectively denote, on the one hand, a stage in which the enzyme is first introduced into the pulp and then, after a certain reaction time and without carrying out washing of the pulp, at least one sequestering agent of metal ions is introduced and, on the other hand, a stage where the enzyme and at least one sequestering agent of metal ions are simultaneously introduced into the pulp. The abbreviation Eo denotes a stage of alkaline extraction reinforced by the presence of oxygen and the abbreviation Eop denotes a similar stage where, in addition to oxygen, a small amount of hydrogen peroxide is incorporated.

The sequences OX/QPPaaP and OXqPC$_A$P have given good results. In these sequences, the abbreviations Paa and C$_A$ respectively denote a stage with peracetic acid and a stage with peroxymonosulphuric acid.

The examples which follow are given with the aim of illustrating the invention, without limiting the scope thereof in any way.

EXAMPLES 1R AND 2R (not in accordance with the invention)

A sample of softwood pulp which has been subjected to a kraft cooking (initial brightness 27.9° ISO, measured according to ISO Standard 2470-1977(F), kappa number 26.7, measured according to SCAN Standard C1-59, and degree of polymerization 1680, expressed as number of glucose units and measured according to SCAN Standard C15-62) was treated according to a 5-stage sequence OQP-C$_A$P under the following conditions:

1st Stage: Stage with oxygen (Stage O):
Pressure, bar: 6
NaOH content, g/100 g of dry pulp: 4
$MgSO_4.7H_2O$ content, g/100 g of dry pulp: 0.5
Temperature, degrees C.: 120
Duration, min: 60
Consistency, % by weight of solids: 12
2nd Stage: Stage with DTPA (Stage Q):
DTPA content, g/100 g of dry pulp: 0.2
Temperature, degrees C.: 50
Duration, min: 105 at pH 7 followed by 15 at pH 5.5
Consistency, % by weight of solids: 3
3rd Stage: Stage with hydrogen peroxide (Stage P):
$H_2O_2$ content, g/100 g of dry pulp: 1
NaOH content, g/100 g of dry pulp: 1.6
$Na_7$DTMPA content, g/100 g of dry pulp: 0.025
$MgSO_4.7H_2O$ content, g/100 g of dry pulp: 0.2
Temperature, degrees C.: 90
Duration, min: 120
Consistency, % by weight of solids: 10
where $Na_7$DTMPA represents the heptasodium salt of diethylenetriaminepenta(methylenephosphonic) acid.
4th Stage: Stage with Caro's acid (Stage C$_A$):
$H_2SO_5$ content, g/100 g of dry pulp: 3 (Ex. 1R) or 4.5 (Ex. 2R)
$Na_7$DTMPA content, g/100 g of dry pulp: 0.025
$MgSO_4.7H_2O$ content, g/100 g of dry pulp: 0.2
Initial pH: 4 to 5
Temperature, degrees C.: 90
Duration, min: 120
Consistency, % by weight of solids: 10
5th Stage: Stage with hydrogen peroxide (Stage P):
$H_2O_2$ content, g/100 g of dry pulp: 2.0
NaOH content, g/100 g of dry pulp: 1.6
Na silicate content, at 38° Bé, g/100 g of dry pulp: 3.0
$MgSO_4.7H_2O$ content, g/100 g of dry pulp: 1.0
Temperature, degrees C.: 90
Duration, min: 240
Consistency, % by weight of solids: 30

At the end of the sequence, after treatment, the kappa number, the degree of polymerization and the brightness of the pulp were determined. The kappa number was also measured after the third stage (P).

| Example No. | Final brightness °ISO | Kappa number after P1 | Final kappa number | Final DP |
|---|---|---|---|---|
| 1R | 89.8 | 6.6 | 1.6 | 960 |
| 2R | 91.4 | 6.6 | 1.2 | 930 |

where P1 symbolizes the 1st Stage P of the sequence (3rd Stage of the sequence).

EXAMPLES 3 AND 4

(in accordance with the invention)

The same pulp sample as in Examples 1R and 2R was bleached according to the sequence OXqPC$_A$P while using, in Stage X, an amount of xylanase derived from *Bacillus pumilus* PRL B12 corresponding to 10 XU/g of dry pulp. The unit XU (Xylanase Unit) is defined as being the amount of xylanase which, under the conditions of the test, catalyses the release of reducing sugars equivalent, in reducing power, to 1 micromole of glucose per minute.

The operating conditions were the following:

1st Stage: Stage with oxygen (Stage O):
Pressure, bar: 6
NaOH content, g/100 g of dry pulp: 4
$MgSO_4.7H_2O$ content, g/100 g of dry pulp: 0.5
Temperature, degrees C.: 120
Duration, min: 60

Consistency, % by weight of solids: 12
2nd Stage: stage with the enzyme xylanase and with DTPA (Stage Xq):
1st phase: enzyme alone
Xylanase content, XU/g of dry pulp: 10
Temperature, degrees C.: 50
Duration, min: 105
Consistency, % by weight of solids: 3
pH: 7
2nd phase: DTPA (without intermediate washing)
DTPA content, g/100 g of dry pulp: 0.2
Temperature, degrees C.: 50
Duration, min: 15
Consistency, % by weight of solids: 3
pH: 5.5
3rd Stage: Stage with hydrogen peroxide (Stage P):
$H_2O_2$ content, g/100 g of dry pulp: 1
NaOH content, g/100 g of dry pulp: 1.6
$Na_7$DTMPA content, g/100 g of dry pulp: 0.025
$MgSO_4.7H_2O$ content, g/100 g of dry pulp: 0.2
Temperature, degrees C.: 90
Duration, min: 120
Consistency, % by weight of solids: 10
where $Na_7$DTMPA represents the heptasodium salt of diethylenetriaminepenta(methylenephosphonic) acid.
4th Stage: Stage with Caro's acid (Stage $C_A$):
$H_2SO_5$ content, g/100 g of dry pulp: 3 (Ex. 3) or 4.5 (Ex. 4)
$Na_7$DTMPA content, g/100 g of dry pulp: 0.025
$MgSO_4.7H_2O$ content, g/100 g of dry pulp: 0.2
Initial pH: 4 to 5
Temperature, degrees C.: 90
Duration, min: 120
Consistency, % by weight of solids: 10
5th Stage: Stage with hydrogen peroxide (Stage P):
$H_2O_2$ content, g/100 g of dry pulp: 2.0
NaOH content, g/100 g of dry pulp: 1.6
Na silicate content, at 38° Bé, g/100 g of dry pulp: 3.0
$MgSO_4.7H_2O$ content, g/100 g of dry pulp: 1.0
Temperature, degrees C.: 90
Duration, min: 240
Consistency, % by weight of solids: 30

At the end of the sequence, after treatment, the kappa number, the degree of polymerization and the brightness of the pulp were determined. The kappa number was also measured after the third stage (P).

The results obtained were:

| Example No. | Final brightness °ISO | Kappa number after P1 | Final kappa number | Final DP |
|---|---|---|---|---|
| 3 | 91.7 | 5.6 | 1.2 | 970 |
| 4 | 92.9 | 5.6 | 1.0 | 940 |

where P1 symbolizes the 1st Stage P of the sequence (3rd Stage of the sequence).

EXAMPLE 5R (not in accordance with the invention)

Another sample of softwood kraft pulp (initial brightness 27.9° ISO, measured according to ISO Standard 2470-1977 (F), kappa number 26.7, measured according to SCAN Standard C1-59, and degree of polymerization 1680, expressed as number of glucose units and measured according to SCAN Standard C15-62) was treated according to a 5-stage sequence OQPPaaP under the following conditions:
1st Stage: Stage with oxygen (Stage O):
Pressure, bar: 5.7
NaOH content, g/100 g of dry pulp: 4
$MgSO_4.7H_2O$ content, g/100 g of dry pulp: 0.5
Temperature, degrees C.: 120
Duration, min: 60
Consistency, % by weight of solids: 12
2nd Stage: Stage with DTPA (Stage Q):
DTPA content, g/100 g of dry pulp: 0.16
Temperature, degrees C.: 60
Duration, min: 60
Consistency, % by weight of solids: 5
3rd Stage: Stage with hydrogen peroxide (Stage P):
$H_2O_2$ content, g/100 g of dry pulp: 1
NaOH content, g/100 g of dry pulp: 1.3
$Na_7$DTMPA content, g/100 g of dry pulp: 0.025
$MgSO_4.7H_2O$ content, g/100 g of dry pulp: 1
Temperature, degrees C.: 90
Duration, min: 120
Consistency, % by weight of solids: 10
where $Na_7$DTMPA represents the heptasodium salt of diethylenetriaminepenta(methylenephosphonic) acid.
4th Stage: Stage with peracetic acid (Stage Paa):
$CH_3CO_3H$ content, g/100 g of dry pulp: 2
$Na_7$DTMPA content, g/100 g of dry pulp: 0.125
Temperature, degrees C.: 90
Duration, min: 360
Consistency, % by weight of solids: 10
5th Stage: Stage with hydrogen peroxide (Stage P):
$H_2O_2$ content, g/100 g of dry pulp: 1
NaOH content, g/100 g of dry pulp: 1
Na silicate content, at 38° Bé, g/100 g of dry pulp: 3
$MgSO_4.7H_2O$ content, g/100 g of dry pulp: 1
Temperature, degrees C.: 80
Duration, min: 360
Consistency, % by weight of solids: 20

At the end of the sequence, after treatment, the kappa number, the degree of polymerization and the brightness of the pulp were determined. The kappa number was also measured after the 3rd Stage (P).

The results obtained were the following:

| Example No. | Final brightness °ISO | Kappa number after P1 | Final kappa number | Final DP |
|---|---|---|---|---|
| 5R | 76.7 | 9.7 | 3.9 | 1050 |

where P1 symbolizes the 1st Stage P of the sequence (3rd Stage of the sequence).

EXAMPLE 6

(in accordance with the invention)

The same pulp sample as in Example 5R was bleached by means of the sequence OX/QPPaaP while using, in Stage X, an amount of xylanase derived from *Bacillus pumilus* PRL B12 corresponding to 5 XU/g of dry pulp.

The operating conditions were the following:
1st Stage: Stage with oxygen (Stage O):
Pressure, bar: 5.7
aOH content, g/100 g of dry pulp: 4
$MgSO_4.7H_2O$ content, g/100 g of dry pulp: 0.5
Temperature, degrees C.: 120
Duration, min: 60
Consistency, % by weight of solids: 12
2nd Stage: Stage with the enzyme and with DTPA (Stage X/Q):

Xylanase content, XU/g of dry pulp: 5
DTPA content, g/100 g of dry pulp: 0.16
Temperature, degrees C.: 60
Duration, min: 60
Consistency, % by weight of solids: 5
3rd Stage: Stage with hydrogen peroxide (Stage P):
$H_2O_2$ content, g/100 g of dry pulp: 1
NaOH content, g/100 g of dry pulp: 1.3
$Na_7DTMPA$ content, g/100 g of dry pulp: 0.025
$MgSO_4.7H_2O$ content, g/100 g of dry pulp: 1
Temperature, degrees C.: 90
Duration, min: 120
Consistency, % by weight of solids: 10
where $Na_7DTMPA$ represents the heptasodium salt of diethylenetriaminepenta(methylenephosphonic) acid.
4th Stage: Stage with peracetic acid (Stage Paa):
$CH_3CO_3H$ content, g/100 g of dry pulp: 2
$Na_7DTMPA$ content, g/100 g of dry pulp: 0.125
Temperature, degrees C.: 90
Duration, min: 360
Consistency, % by weight of solids: 10
5th Stage: Stage with hydrogen peroxide (Stage P):
$H_2O_2$ content, g/100 g of dry pulp: 1
NaOH content, g/100 g of dry pulp: 1
Na silicate content, at 38° Bé, g/100 g of dry pulp: 3
$MgSO_4.7H_2O$ content, g/100 g of dry pulp: 1
Temperature, degrees C.: 80
Duration, min: 360
Consistency, % by weight of solids: 20

At the end of the sequence, after treatment, the kappa number, the degree of polymerization and the brightness of the pulp were determined. The kappa number was also measured after the 3rd Stage (P).

The results obtained were the following:

| Example No. | Final brightness °ISO | Kappa number after P1 | Final kappa number | Final DP |
|---|---|---|---|---|
| 6 | 79.2 | 8.7 | 3.2 | 1060 |

where P1 symbolizes the 1st Stage P of the sequence (3rd Stage of the sequence).

We claim:

1. A process for bleaching pulp comprising bleaching the pulp with one of the following bleach sequences, wherein each bleach sequence consists essentially of the following stages:

an oxygen stage with seguestering agent, followed by a stage with an enzyme, followed by a stage with hydrogen peroxide, followed by a stage with a peroxyacid, followed by a stage with hydrogen peroxide; an oxygen stage with an enzyme followed by a stage with sequestering agent, followed by a stage with hydrogen peroxide, followed by a stage with a peroxyacid, followed by a stage with hydrogen peroxide; an oxygen stage with an enzyme and with a sequestering agent, followed by a stage with hydrogen peroxide, followed by a stage with a peroxyacid, followed by a stage with hydrogen peroxide; or an oxygen stage with an enzyme reinforced with a sequestering agent, followed by a stage with hydrogen peroxide, followed by a stage with a peroxyacid, followed by a stage with hydrogen peroxide.

2. The process according to claim 1, wherein the stage with an enzyme comprises at least one xylanase.

3. The process according to claim 2, wherein said at least one xylanase is derived from a bacterium of the Bacillus genus and of the pumilus species.

4. The process according to claim 1, wherein the stage with an enzyme is carried out in the absence of any cellulase.

5. The process according to claim 1, wherein the pulp comprises kraft pulp.

6. A process for bleaching pulp comprising bleaching the pulp with one of the following bleach sequences, wherein each bleach sequence consists essentially of the following stages:

an oxygen stage with an enzyme and with a seguestering agent, followed by a stage with hydrogen peroxide, followed by a stage with peracetic acid, followed by a stage with hydrogen peroxide; an oxygen stage with an enzyme reinforced with a seguestering agent, followed by a stage with hydrogen peroxide, followed by a stage with peracetic acid, followed by a stage with hydrogen peroxide; an oxygen stage with an enzyme and with a seguestering agent, followed by a stage with hydrogen peroxide, followed by a stage with peroxymonosulfuric acid, followed by a stage with hydrogen peroxide; or an oxygen stage with an enzyme reinforced with a seguestering agent, followed by a stage with hydrogen peroxide, followed by a stage with peroxymonosulfuric acid, followed by a stage with hydrogen peroxide.

7. The process according to claim 6, wherein the stage with an enzyme comprises at least one xylanase.

8. The process according to claim 7, wherein said at least one xylanase is derived from a bacterium of the Bacillus genus and of the pumilus species.

9. The process according to claim 6, wherein the stage with an enzyme is carried out in the absence of any cellulase.

10. The process according to claim 6, wherein the pulp comprises kraft pulp.

11. A process for bleaching pulp comprising bleaching the pulp with one of the following bleach sequences, wherein each bleach sequence consists essentially of the following stages:

an oxygen stage with an enzyme and with a sequestering agent, followed by a stage with peracetic acid, followed by a stage with hydrogen peroxides; an oxygen stage with an enzyme reinforced with a sequestering agent, followed by a stage with peracetic acid, followed by a stage with hydrogen peroxide; an oxygen stage with an enzyme and with a sequestering agent, followed by a stage with peroxymonosulfuric acid, followed by a stage with hydrogen peroxide; or an oxygen stage with an enzyme reinforced with a sequestering agent, followed by a stage with peroxymonosulfuric acid, followed by a stage with hydrogen peroxide.

12. The process according to claim 11, wherein the stage with an enzyme comprises at least one xylanase.

13. The process according to claim 12, wherein said at least one xylanase is derived from a bacterium of the Bacillus genus and of the pumilus species.

14. The process according to claim 11, wherein the stage with an enzyme is carried out in the absence of any cellulase.

15. The process according to claim 11, wherein the pulp comprises kraft pulp.

16. A process for bleaching pulp comprising bleaching the pulp with one of the following bleach sequences, wherein each bleach sequence consists essentially of at least one stage selected from the group consisting of a washing stage and a dewatering stage between any of the stages, and the following stages:

an oxygen stage with sequestering agent, followed by a stage with an enzyme, followed by a stage with hydrogen peroxide, followed by a stage with a peroxyacid, followed by a stage with hydrogen peroxide; an oxygen stage with an enzyme, followed by a stage with sequestering agent, followed by a stage with hydrogen peroxide, followed by a stage with a peroxyacid, followed by a stage with hydrogen peroxide; an oxygen stage with an enzyme and with a sequestering agent, followed by a stage with hydrogen peroxide, followed by a stage with a peroxyacid, followed by a stage with hydrogen peroxide; or an oxygen stage with an enzyme reinforced with a sequestering agent, followed by a stage with hydrogen peroxide, followed by a stage with a peroxyacid, followed by a stage with hydrogen peroxide.

17. The process according to claim 16, wherein the stage with an enzyme comprises at least one xylanase.

18. The process according to claim 17, wherein said at least one xylanase is derived from a bacterium of Bacillus genus and of the pumilus species.

19. The process according to claim 16, wherein the stage with an enzyme is carried out in the absence of any cellulase.

20. The process according to claim 16, wherein the pulp comprises kraft pulp.

21. A process for bleaching pulp comprising bleaching the pulp with one of the following bleach sequences, wherein each bleach sequence consists essentially of at least one stage selected from the group consisting of a washing stage and a dewatering stage between any of the stages, and the following stages:

an oxygen stage with an enzyme and with a sequestering agent, followed by a stage with hydrogen peroxide, followed by a stage with peracetic acid, followed by a stage with hydrogen peroxide; an oxygen stage with an enzyme reinforced with a sequestering agent, followed by a stage with hydrogen peroxide, followed by a stage with peracetic acid, followed by a stage with hydrogen peroxide; an oxygen stage with an enzyme and with a sequestering agent, followed by a stage with hydrogen peroxide, followed by a stage with peroxymonosulfuric acid, followed by a stage with hydrogen peroxide; or an oxygen stage with an enzyme reinforced with a sequestering agent, followed by a stage with hydrogen peroxide, followed by a stage with peroxymonosulfuric acid, followed by a stage with hydrogen peroxide.

22. The process according to claim 21, wherein the stage with an enzyme comprises at least one xylanase.

23. The process according to claim 22, wherein said at least one xylanase is derived from a bacterium of Bacillus genus and of the pumilus species.

24. The process according to claim 21, wherein the stage with an enzyme is carried out in the absence of any cellulase.

25. The process according to claim 21, wherein the pulp comprises kraft pulp.

26. A process for bleaching pulp comprising bleaching the pulp with one of the following bleach sequences, wherein each bleach sequence consists essentially of at least one stage selected from the group consisting of a washing stage and a dewatering stage between any of the stages, and the following stages:

an oxygen stage with an enzyme and with a sequestering agent, followed by a stage with peracetic acid, followed by a stage with hydrogen peroxide; an oxygen stage with an enzyme reinforced with a sequestering agent, followed by a stage with peracetic acid, followed by a stage with hydrogen peroxide; an oxygen stage with an enzyme and with a sequestering agent, followed by a stage with peroxymonosulfuric acid, followed by a stage with hydrogen peroxide; or an oxygen stage with an enzyme reinforced with a sequestering agent, followed by a stage with peroxymonosulfuric acid, followed by a stage with hydrogen peroxide.

27. The process according to claim 26, wherein the stage with an enzyme comprises at least one xylanase.

28. The process according to claim 27, wherein said at least one xylanase is derived from a bacterium of Bacillus genus and of the pumilus species.

29. The process according to claim 26, wherein the stage with an enzyme is carried out in the absence of any cellulase.

30. The process according to claim 26, wherein the pulp comprises kraft pulp.

* * * * *